United States Patent [19]

Fee

[11] 4,274,582

[45] Jun. 23, 1981

[54] SEPARATE INSULATOR PAD BETWEEN A CLIP AND A RAILROAD RAIL

[75] Inventor: Graham M. Fee, Geneva, Ohio

[73] Assignee: True Temper Corporation, Cleveland, Ohio

[21] Appl. No.: 71,884

[22] Filed: Sep. 4, 1979

[51] Int. Cl.[3] ..... E01B 9/30

[52] U.S. Cl. ..... 238/349; 238/310; 238/338

[58] Field of Search ..... 238/310, 338, 349, 351

[56] References Cited

U.S. PATENT DOCUMENTS

| | | | |
|---|---|---|---|
| 3,362,639 | 1/1968 | VanSant | 238/349 |
| 3,460,756 | 8/1969 | Sansom | 238/338 |
| 3,477,642 | 11/1969 | Jackson | 238/349 |
| 3,610,526 | 10/1971 | Burwell | 238/349 X |
| 4,104,483 | 8/1978 | Seeley | 238/349 X |

FOREIGN PATENT DOCUMENTS

| | | | |
|---|---|---|---|
| 805878 | 5/1951 | Fed. Rep. of Germany | 238/351 |
| 957500 | 5/1964 | United Kingdom | 238/351 |
| 990895 | 5/1965 | United Kingdom | 238/351 |

*Primary Examiner*—Randolph A. Reese

*Attorney, Agent, or Firm*—Baldwin, Egan, Walling & Fetzer

[57] ABSTRACT

A separate insulator pad generally L-shaped in section, has a longer leg which is flat and which is held firmly between the inclined flange of the rail on one side and the inclined surface of the holding clip on the other side. The pad has upstanding shoulders on opposite sides in the direction of rail travel and the clip fits between the shoulders to prevent longitudinal slippage of the pad relative to the clip. The shorter leg of the pad extends snugly between the outer edge of the rail flange and a downwardly extending leg of the clip thus preventing lateral movement of the rail and at the same time, insulating the rail from the fastener structure.

18 Claims, 6 Drawing Figures

SEPARATE INSULATOR PAD BETWEEN A CLIP AND A RAILROAD RAIL

FIELD OF THE INVENTION

This is an insulated rail fastener of the resilient clip type using an electrically insulating layer between the clip and the rail flange to insulate the rail from the fastening device.

DESCRIPTION OF THE PRIOR ART

The prior art includes U.S. Pat. No. 2,315,444 granted Mar. 30, 1943 to John N. Meade; U.S. Pat. No. 2,928,605 granted Mar. 15, 1960 to Philip J. Kirst; U.S. Pat. No. 3,080,120 granted Mar. 5, 1963 to Harry M. DeTurk; U.S. Pat. No. 3,460,756 granted Aug. 2, 1969 to Leopold S. Sanson; U.S. Pat. No. 3,827,631 granted Aug. 6, 1974 to Edward F. Kirik; U.S. Pat. No. 3,888,414 granted June 1, 1975 to Michel Duchemin; U.S. Pat. No. 3,970,248 granted July 20, 1976 to George Molyneux; U.S. Pat. No. 4,026,466 granted May 31, 1977 to Michel Duchemin; U.S. Pat. No. 4,066,212 granted Jan. 3, 1978 to Roger P. Sonneville; and U.S. Pat. No. 4,111,361 granted Sept. 5, 1978 to Roger P. Sonneville. None of these prior patents show a separate insulator pad, L-shaped in section having the longer leg of the L-shaped held between the end of the clip and the flange of the rail and having the shorter leg of the L-shape pad held between the outer edge of the rail flange and a vertical leg of the clip.

SUMMARY OF THE INVENTION

The insulator pad comprises a central flat portion which is the longer leg of an L-shaped pad and which flat portion is of a width to receive the entire width of the clip between upstanding shoulders on opposite sides of the insulator pad in position to rest against the received edges of the holding clip. The insulator pad has a shorter leg extending downwardly from the outer edge of the flat portion previously mentioned, in position to rest snugly between the outer edge of the rail flange and an integral downwardly extending leg of the fastener clip.

DESCRIPTION OF THE PREFERRED EMBODIMENTS

Figure 1:
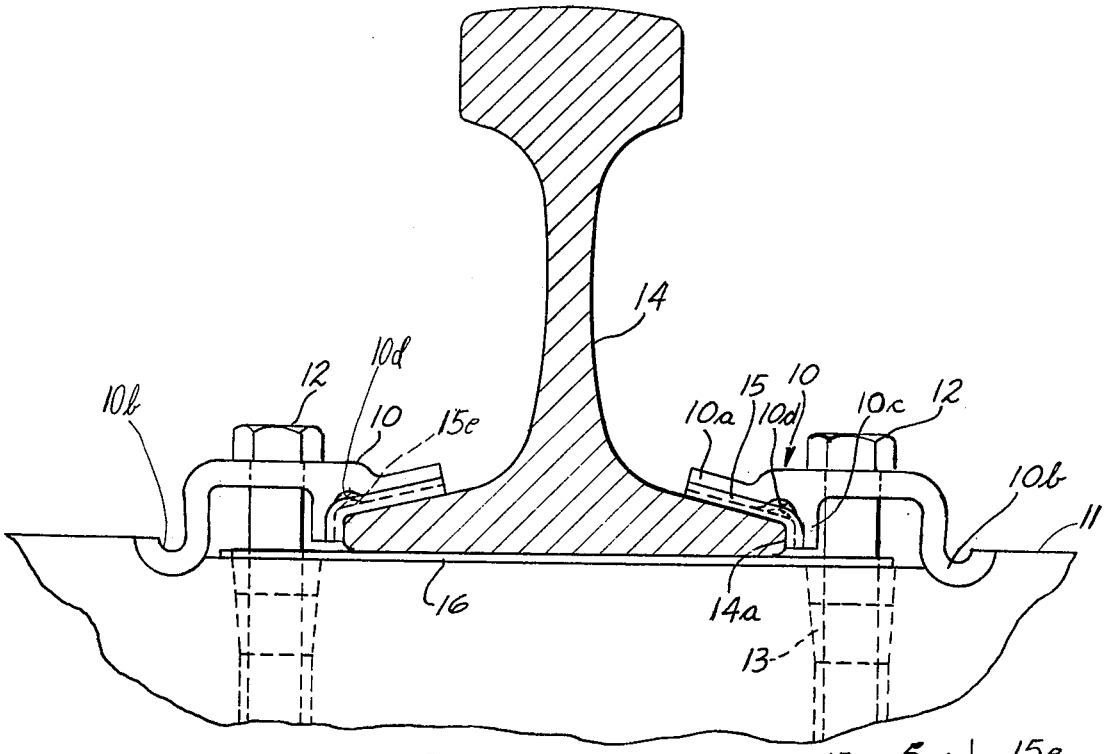
FIG. 1 is a sectional view through a rail showing the insulator pads of this invention secured by clips aligned on opposite sides of the rail and held down against the insulator pads by bolts.

The integral insulator pad of this invention is intended for use with a resilient clip 10 having an inner end 10*a* resting on the rail flange and having an outer end 10*b* held in the cross support 11 which in this illustration is a concrete tie. Bolts 12 pass through suitable openings in the clips 10 and are screwed into the tie 11, usually using an adapter structure 13 of standard construction for holding the threads of the bolts firming in position. Each clip has an integral downwardly extending leg 10*c* positioned a little bit outside of the outer edge of the rail flange 14*a* and so positioned as to receive the outer portion of the insulator pad 15 snugly between the rail flange edge 14*a* and the leg 10*c*. It will be noticed that the leg 10*c* stops short of contact with the cross tie 11.

Figure 2:
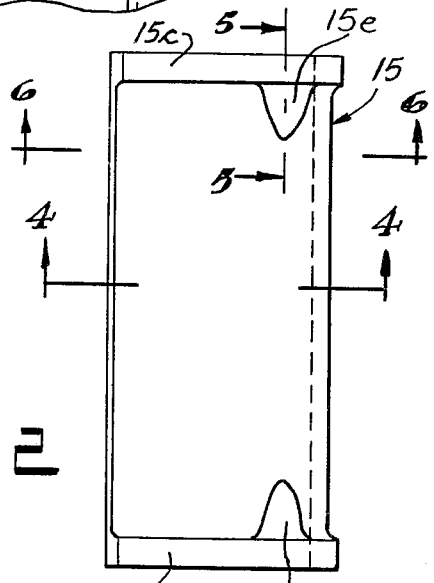
FIG. 2 is a plan view of one of the insulator pads looking downwardly on the structure of FIG. 1 with the clip removed.
Figure 4:
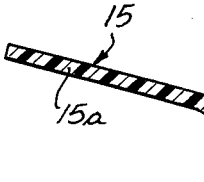
FIG. 4 is a sectional view taken along the line 4—4 of FIG. 2.
Figure 5:
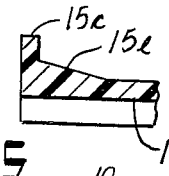
FIG. 5 is a fragmental sectional view taken along the line 5—5 of FIG. 2.
Figure 6:
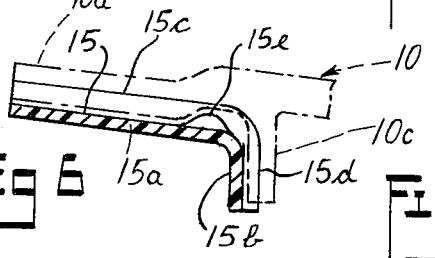
FIG. 6 is a sectional view taken along the line 6—6 of FIG. 2.
Figure 3:
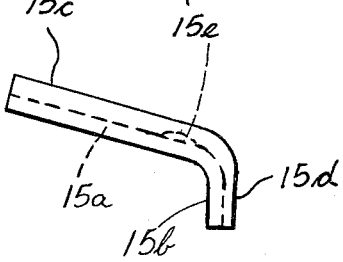
FIG. 3 is an end elevational view of the insulator pad shown in FIG. 2.

The separate insulator pad 15 of this invention is shown enlarged in FIGS. 2, 3, 4, 5 and 6 to more clearly disclose the structure shown in FIG. 1. The insulator pad is preferably molded from a synthetic resin having electrical insulating qualities and in the embodiment shown herein, is about 0.100 inches thick and has an L-shaped form of which the longer leg 15*a* is about 1½ inches long and the shorter leg 15*b* is about ½ inch long. The clip 10 used in this invention is similar to that shown and claimed in U.S. Pat. No. 3,477,642 granted Nov. 11, 1969 to Carl T. Jackson. It is made of strong resilient steel. The clip used in this invention has its inner end 10*a* bent upwardly at an angle parallel to the upper surface of the flange of the railroad rail which slopes downwardly and outwardly at a predetermined angle to the flange outer edge 14*a*. The insulator pad 15 has parallel upper and lower surfaces which incline outwardly and downwardly at the same angle as the slope on the rail flange extending from the rail outwardly so that the longer leg 15*a* of the L-shape insulator pad 15 fits snugly between the clip portion 10*a* and the rail flange as seen in FIG. 1. The shorter leg 15*b* of the insulator pad extends vertically downwardly from the outer edge of the flat central portion of the pad as best seen in FIGS. 3 and 4. The parts are so arranged that this shorter leg fits snugly between the outer edge 14*a* of the flange and the inner face of the leg 10*c* of the clip as best seen in FIG. 1.

As shown in FIGS. 2 and 3, each integral insulator pad 15 has integral upstanding shoulders 15*c* along parallel side edges of the central flat portion 15*a* and these shoulders are of a thickness to rest snugly between the opposite edges of the clip 10 which, in the position shown in FIG. 1, rests closely between the opposite shoulders 15*c* shown in FIG. 2. Thus, the insulator pad extends completely across the full width of the clip 10 in the direction of rail travel. As best seen in FIGS. 1 and 3, the shoulder portions 15*c* extend along the flat portion 10*a* of the clip. Preferably, the shoulders then extend downwardly as at 15*d* to rest snugly against the outer vertical surface of the shorter leg 10*c* of the clip.

Preferably, the clip has an upward bend at 10*d* which occurs at the outer edge of the flat portion 10*a* of the clip. In this structure, the pad is provided with short raised rib portions 15*e* at opposite ends (or sides of the pad), which extend longitudinally away from the shoulder portions 15*c* in order to fit generally snugly into the short bend 10*d* of the clip 10, and to strengthen the insulator pad. The insulator pad may be used without the raised portions 15*e*.

A satisfactory synthetic resin for use in making the insulator pad of this invention is of fiberglass reinforced 66 nylon made by E. I. DuPont de Nemours & Co. and sold under the tradename Zytel 70G33L. Any other synthetic resin having similar characteristics would be satisfactory. The qualities of Zytel used in one form of this invention is shown in the accompanying list. It should be understood that the number at the beginning of each item is the name of the American Society for Testing Materials for particular test for that quality.

D638 Tensile strength at 73° F. (p.s.i.)=27,000–18,000
D638 Elongation to break at 73° F. (%)=3–4%
D638 Shear strength (p.s.i.)=12,500
D790 Flexural Modulus 73° F. (p.s.i.)=1,300,000–900,000
D621 Deformation under load 2,000 p.s.i. (%)=0.8%
D648 Heat deflection temp. at 264 p.s.i. °F.=480° F.
D256 Izod impact strength 73° F. ft. lb/in=2.0

FIG. 1 of the drawings shows a sheet of synthetic resin 16 extending across the cross tie 11 beneath the flange of the rail and somewhat beyond the outer end of the same. This however forms no part of the present invention except it completes the insulation of the rail from the concrete tie.

This invention makes it possible to easily assemble the insulator pad with the suitable clip structure either as a new installation or as a repair to an older installation. The pad is simple in structure and easily constructed by molding techniques and is a reasonably cheap and satisfactory method of insulating a steel railroad rail from its fastening structure.

What is claimed is:

1. An integral insulator pad of synthetic resin for use with a resilient clip for fastening a railroad rail to a cross support, said rail having a bottom flange to rest on said support, said flange having an upper surface sloping downwardly and outwardly at a certain angle to the flange outer end, said clip being of a predetermined width measured lengthwise of the rail and having a length at right angles to said width extending from an inner end resting on said flange to an outer end resting on said cross support, said clip having a downwardly extending leg just outside the outer end of said flange and terminating slightly short of said cross support, there being a through opening in said clip between said leg and said clip outer end to receive a fastener bolt to enter into said support for drawing said clip against said rail flange and said support, said inner end of said clip having a lower flat surface sloping downwardly and outwardly at said certain angle lengthwise of said clip inner end for a substantial distance extending from said clip inner end to part way to said leg, resulting in a clip which has a short upward bend adjacent said downwardly extending leg of said clip, and intermediate said leg and said lower surface, characterized in that said insulator pad is of electrically insulating material and comprises a central flat portion of a width to receive the entire predetermined width of said clip, said flat portion having flat upper and lower surfaces commencing respectively adjacent the plane of said inner end of said clip and the innermost end edge of said pad to contact snugly respectively said inner end of said clip and said rail flange upper surface sloping downwardly and outwardly at said certain angle, each of said upper and lower surfaces of said flat portion being disposed in a respective single plane extending parallel to one another and to the plane of said upper surface of said rail flange, said insulator pad then having a portion along its entire width extending vertically downward and of a thickness adapted to rest snugly between said leg and said flange outer end, said flat portion of said pad having a considerably greater length as compared to the length of said downwardly extending portion of said pad resulting in a generally L-shaped configuration for said pad in side elevation, said inner end of said clip engaging said upper surface of said pad commencing immediately adjacent said innermost end edge of said pad and extending lengthwise therealong for a predetermined substantial distance, said pad commencing adjacent said innermost end edge thereof having integral upstanding shoulder portions along parallel side edges of said central flat portion of said pad at right angles to the rail direction and spaced to receive the full width of said clip between them, said upstanding shoulder portions extending toward said leg continuously along said inner end of said clip and generally past said upward bend in said clip, said shoulder portions then curving and extending down said downwardly extending portion of said insulator pad, said pad having rib means extending from said shoulder portions transverse of said pad upper surface and extending upwardly from said pad upper surface, said rib means being adapted for generally snug reception in said short bend of the clip for aiding in locating the pad relative to the clip, whereby said pad, when fastened, may be firmly held between said clip inner end and said rail flange and also held between said leg and said rail flange outer end, and said shoulder portions will prevent slippage between said pad and said clip in the longitudinal direction of said rail.

2. Two insulator pads as defined in claim 1, aligned crosswise of said rail on opposite sides thereof.

3. An integral insulator pad as defined in claim 1, said rib means comprising short raised portions extending from said integral upstanding shoulder portions at opposite sides of the pad, and aligned with respect to one another in the longitudinal direction of the rail.

4. An integral insulator pad as defined in claim 1 in combination with said clip as set forth in claim 1.

5. The combination in accordance with claim 4 wherein the area of engagement between said upper surface of said flat portion of said pad and said lower surface of said inner end of said clip is at least twice the engageable area between said downwardly extending portion of said pad and the clip leg.

6. The combination in accordance with claim 4 wherein said rib means is disposed below the level of the top edge of said shoulder portions and is received in said short bend of said clip.

7. An integral insulator pad as defined in claim 1, in combination with said clip as set forth in claim 1, and in combination with a railroad rail resting on a cross support.

8. The combination in accordance with claim 7 wherein said clip at said outer end thereof comprises an upwardly opening generally U-shaped section in side elevation received in an abutment seat in said cross support and a bridging portion connecting said U-shaped portion with said leg, said clip being spaced from said cross support except at said outer end engagement therewith, said bolt extending through said bridging portion adjacent said leg and forcing said clip into engagement with said cross support at said outer end thereof and also urging full bearing engagement between said inner end of said clip and the underlying flat portion of said pad, and between the latter and said rail flange upper surface, commencing adjacent said inner end of said clip and said innermost end edge of said pad.

9. An insulator pad in accordance with claim 7 wherein said clip at said outer end thereof comprises an upwardly opening generally U-shaped section in side elevation, received in an abutment seat on said support and a bridging portion connecting said U-shaped portion with said leg, with said bolt being disposed adjacent said leg of said clip, through said bridging portion thereof, said clip being spaced from said support except at said outer end engagement therewith, whereby upon predetermined tightening of the bolt the clip outer end is urged into tight engagement with aid abutment seat, and said inner end of the clip is urged into tight surface-to-surface engagement with said upper surface of said flat portion of said pad, commencing adjacent the innermost end edge of said pad and said inner end of said clip, and extending for a major portion of the lengthwise extent of said upper surface of said pad.

10. An insulator pad as defined in claim 1 wherein said rib means on said pad extends generally perpendicular to said shoulder portions and upwardly from said upper surface of said pad generally adjacent the juncture of said downwardly extending portion and said flat portion of said pad, said rib means being disposed below the level of the top edge of said shoulder portions.

11. An insulator pad in accordance with claim 10 wherein said rib means comprises spaced raised portions, each of which slopes in a direction transverse of said upper surface of said flat portion from said upper surface of said flat portion upwardly and merges with the inner side surface of the respective shoulder portion of said pad, but below said top edge of said respective shoulder portion.

12. An insulator pad in accordance with claim 10 wherein the flat portion of said pad is of a length approximately three times the length of said downwardly extending portion of said pad.

13. An insulator pad in accordance with claim 1 wherein said juncture between said lower surface of said flat portion of said pad and said downwardly extending portion of said pad is a smooth curve conforming generally with the curvature of said rail flange at said flange outer end.

14. An insulator pad in accordance with claim 13 wherein said shoulder portions along said side edges of said flat portion thereof project a greater distance away from said upper surface of said flat portion of said pad as compared to the distance of projection of said shoulder portions on said downwardly projecting portion of said pad.

15. An insulator pad in accordance with claim 1 formed from fiberglass reinforced nylon and which possesses the following parameters: a tensile strength of between 18,000 to 27,000 pounds per square inch at 73° F., elongation to break at 73° F. of 3 to 4%; shear strength of 12,500 p.s.i.; flexural modulus at 73° F. of 900,000 to 1,300,000 p.s.i.; deformation under a load of 2,000 p.s.i. of 0.8%; heat deflection temperature at 264 p.s.i. of 480° F.; and Izod impact strength at 73° F. of 2 foot-pound per inch.

16. An integral insulator pad of synthetic resin adapted for use with a resilient clip for fastening a railroad rail to a cross support, with the rail having a bottom flange adapted to be supported on the cross support, the flange having an upper surface sloping downwardly and outwardly at a certain angle to the flange outer end, the clip being of predetermined width measured in the longitudinal direction of the rail, and having a length measured at right angles to the clip width extending from an inner end adapted to be supported by the flange to an outer end adapted to rest on the cross support, the clip having a downwardly extending leg just outside the outer end of the flange and terminating short of the cross support, there being a through opening in the clip between the clip leg and the outer end of the clip adapted to receive a fastener to coact with the support for drawing the clip against the rail flange and the support, the inner end of the clip having a lower flat surface which in use slopes downwardly and outwardly at an angle generally complementary to the upper surface of the rail flange, with the clip having a short upward bend adjacent the downwardly extending leg of the clip and intermediate the clip leg and the clip lower flat surface, characterized in that said insulator pad is of electrically insulating material and comprises a central flat portion of a width adapted to receive the entire width of the clip, with said flat portion having flat upper and lower surfaces commencing respectively adjacent the innermost end edge of said pad adapted to contact generally snugly respectively the inner end of the clip and the upper surface of the rail flange, each of said upper and lower surfaces of said flat portion being disposed in a respective single plane extending generally parallel to one another and adapted to extend generally parallel to the plane of the upper surface of the rail flange, said insulator pad having a portion extending downwardly from said flat portion and adapted to rest generally snugly between the clip leg and the rail flange outer end, said flat portion of said pad having a considerably greater length as compared to the length of said downwardly extending portion of said pad, resulting in a generally L-shaped configuration for said pad in side elevation, the inner end of the clip being adapted to engage said upper surface of said pad along a substantial distance of said upper pad surface lengthwise thereof, said pad having integral upstanding shoulders along parallel side edges of said flat portion of said pad at generally right angles to said upper pad surface and spaced so as to be able to receive the full width of the clip between them, said upstanding shoulders extending lengthwise in a direction away from said innermost end edge of said pad past the juncture of said flat portion and said downwardly extending portion, and extending down said downwardly extending portion of said pad, said pad generally adjacent said juncture having rib means extending transverse of said pad and adapted for extension in the general longitudinal direction of an associated rail, said rib means extending upwardly from said upper surface of said flat portion of said pad and adapted to fit generally snugly into the short upward bend of the clip, for aiding in locating said pad with respect to the clip, whereby said pad, when fastened, may be generally firmly held between the clip and the rail flange and between the clip leg and the rail flange outer end, and said shoulders will prevent slippage between said pad and the clip in the longitudinal direction of the rail.

17. An insulator pad in accordance with claim 16 wherein said rib means is disposed below the level of the top edge of said shoulders.

18. An insulator pad in accordance with claim 17 wherein said rib means comprises transversely spaced, raised, short linear portions generally aligned with respect to one another and extending generally perpendicular from a respective of said shoulders.

* * * * *